US007896059B2

(12) United States Patent
Hetke

(10) Patent No.: US 7,896,059 B2
(45) Date of Patent: Mar. 1, 2011

(54) METAL CASTING SYSTEM, ENGINEERED MOLDS, PROCESS AND ARTICLES MADE THEREBY

(76) Inventor: Adolf Hetke, Brooklyn, MI (US)

( * ) Notice: Subject to any disclaimer, the term of this patent is extended or adjusted under 35 U.S.C. 154(b) by 371 days.

(21) Appl. No.: 12/159,924

(22) PCT Filed: Jan. 3, 2007

(86) PCT No.: PCT/US2007/060055

§ 371 (c)(1),
(2), (4) Date: Jul. 2, 2008

(87) PCT Pub. No.: WO2007/079482

PCT Pub. Date: Jul. 12, 2007

(65) Prior Publication Data

US 2008/0308249 A1 Dec. 18, 2008

Related U.S. Application Data

(60) Provisional application No. 60/755,910, filed on Jan. 3, 2006.

(51) Int. Cl.
*B22D 18/04* (2006.01)
*B22D 18/06* (2006.01)
*B22D 41/00* (2006.01)

(52) U.S. Cl. ..... 164/66.1; 164/119; 164/259; 164/306; 164/335

(58) Field of Classification Search ..... 164/66.1, 164/119, 259, 306, 335
See application file for complete search history.

(56) References Cited

U.S. PATENT DOCUMENTS

| | | | | |
|---|---|---|---|---|
| 4,733,714 | A * | 3/1988 | Smith | 164/130 |
| 4,858,672 | A * | 8/1989 | Chandley | 164/63 |
| 2004/0050525 | A1 * | 3/2004 | Kennedy et al. | 164/306 |
| 2004/0244935 | A1 * | 12/2004 | Nakao et al. | 164/56.1 |

* cited by examiner

*Primary Examiner* — Kuang Lin

(57) ABSTRACT

Disclosed is a metal casting system, an engineered mold for use therewith, a process for utilizing the system and mold, and articles having a clean, oxide-free sand casting of molten metals that have been produced under an inert environment. This is especially advantageous for making automotive and airplane parts from the manufacture of lightweight metals, and more especially for the production of magnesium parts in order to reduce weight while maintaining properties found in other lightweight metals. Currently, sand cast articles are being used for automotive, aerospace and semiconductor parts and other industrial applications. The advantages of the present invention include a greatly reduced cycle time as conventional gating systems no longer apply; an ability to pour highly reactive metals by the use of a protective environment; even greater reduced cycle times because speed of metal delivery is greatly increased; carbon outgassing by binder resin is minimized since no oxygen is allowed into the process; sand and resin usage and disposal is minimized due to the new engineered mold; and cooling of the poured sand casting is much faster through these unique features.

12 Claims, 6 Drawing Sheets

METAL CASTING SYSTEM, ENGINEERED MOLDS, PROCESS AND ARTICLES MADE THEREBY

BACKGROUND OF THE INVENTION

Sand casting of lightmetals has been a process that has been done for a long time. To form a sand casting, sand is mixed with a binder resin, a cavity is formed within a block of this sand-binder combination, and molten metal is poured into the cavity to form a molded metal part. There have always been problems with this method, including the production of dross and oxidized state metals at the surface, along with all the problems of what to do with the sand after the casting has been made. Disposal of hundreds of pounds of sand for each casting is becoming a bigger and bigger problem. Because each casting mold, for example, an engine block, is used only once, six hundred pounds of sand need to be disposed of.

In addition, another problem arises because delivery of the molten metal is a relatively slow process into the sand cast mold because of turbulence issues, i.e. oxide problems need to be alleviated for faster delivery times. In yet another aspect of the conventional sand-cast method, cooling occurs relatively slowly, which reduces cycle time.

Many industries utilize sand casting for production of their parts, and they just live with the issues that are discussed hereinabove when making their production pieces. One such industry, i.e. the automobile industry, would benefit greatly from a reduced cycle time, mold weight reduction to alleviate disposal, and a reduced cycle time, in order to speed up production. Currently, lightmetals have become used more and more in the production of automobiles, in order to achieve better fleet mileages.

For the past several decades, automobile companies in the United States have been attempting to make fuel-efficient vehicles with reduced weights in order to provide environmentally friendly vehicles. A weight reduction in their vehicles is necessitated to reduce the fuel consumption required by these vehicles. It is desirable for American automobile companies to achieve better fuel economy and emission-free automobiles.

Lower fuel consumption regulations have been incorporated into governmental and industry changes that are desirable. As the most popular vehicles are large SUV's and trucks, which do not easily lend themselves to weight reduction, those weight reductions come through new designs and lightweight material substitutions, and not simply through the marketing of smaller, lightweight vehicles. It is, therefore, a goal of American automobile companies to produce desirable vehicles with a substantially reduced weight, utilizing recyclable materials, and exhibiting fuel efficiency and reduced emissions from the power trains. As energy prices are trending upward sharply, cost and weight reduction shall be urged forward by economic pressures, along with the United States Federal Government specifying fuel economy and emissions reduction targets in both passenger and light-trucks/SUVs.

One of the largest weight components of a vehicle is the engine block. Traditionally made of cast iron, there is an opportunity for a materials substitution to achieve weight reduction without sacrificing any of the performance. In the past, new materials that have been investigated included lightmetals and plastics. By way of historical perspective, in 1981, the average vehicle had 650 pounds of iron castings. By contrast, in 1995, iron consumption had declined to 350 pounds and is forecasted to reach only 215 pounds per vehicle by the year 2005. For a limited number of applications, the utilization of lighter materials, such as aluminum and plastic or composite polymer-based materials, currently meet the requirements of automotive companies for strength and durability. Aluminum applications have continued to grow until there is now over 350 pounds per average vehicle of aluminum parts.

Magnesium is one-third lighter than aluminum, while retaining the strength, wear and durability qualities needed by the automotive industry. Consequently, magnesium, or its alloys, is seen as the preferred new lightweight material to be utilized. Under certain manufacturing circumstances, though, magnesium can burn and is considered dangerous in certain applications and processes.

In order to provide safe processing of magnesium, conventional magnesium parts have been made by die castings. The industry is now looking for innovative non-die casting processing methods, especially for cold stamping or forming and low temperature low-pressure sand casting of magnesium. For the industry to review such non-die casting processes, there is a need for more of those innovative processes to be initiated. In fact, the automobile industry has identified potential die cast magnesium components which total about 250 pounds per vehicle. If engine blocks and large structural parts could be made of magnesium, there may be an additional 250 pounds per vehicle which can be made in non-die casting processes for large structural castings while still maintaining strength and durability requirements.

With the use of aluminum castings and plastics approaching a point of diminishing return from a cost-benefit perspective, magnesium or its alloys may become a major factor in the material selection process for automotive components and castings. Therefore, not only should one expect the use of magnesium die castings to grow in volume, but alternative casting processes can open the potential for magnesium components that heretofore were unable to be processed with die casting. Conventional metal die castings of lightmetals, such as aluminum, magnesium and their alloys, provide a greater opportunity for oxide formation on the surface of the molten magnesium.

In order to capture the attention of the automobile industry, it is always preferable to provide new manufacturing methods that have a low initial cost with high production rates, including a low cycle time. It is especially desirable if the new manufacturing method is amenable to the retrofitting of existing foundry equipment. When considering such a method, it should also be inexpensive to operate and to maintain.

A further advantage could be realized if the sand molds that are used in traditional sand castings for aluminum could be modified in order to reduce the amount of sand. Reclamation is needed when a mold has been utilized and must be recycled, and this reclamation process is time consuming and expensive. Therefore, there would be an advantage to reduce the amount of sand in each mold, as well as to provide porosity for the utilization of heat transferring gases which may be included. This "fast cast" system would be desirable for all lightmetal automotive applications as they generate the least amount of waste. This resulting lightmetal casting would achieve yet another advantage because it also needs to have a good molecular structure in order to provide for high quality castings that will be suitable for use in non-die casting component applications.

In these regards, the present invention provides a new method, machine, and precision sand cast mold which shall be advantageous in the automobile industry for non-die casting processed magnesium lightweight automobile and truck components.

SUMMARY OF THE INVENTION

In accordance with the present invention, the advantages suggested above are realized and disclosed herein. In that regard, the present invention provides a system, mold and process that will produce articles having a clean, oxide-free sand casting of molten metals that have been produced under an inert environment. This is especially advantageous for the manufacture of lightweight metals, and more especially for the production of magnesium parts in order to reduce weight while maintaining properties found in other lightweight metals currently being used for automotive, aerospace and semiconductor parts and other industrial applications.

The advantages of the present invention include:

1.) a greatly reduced cycle time as conventional gating systems no longer apply;
2.) ability to pour highly reactive metals by the use of a protective environment;
3.) even greater reduced cycle times because speed of metal delivery is greatly increased;
4.) since no oxygen is allowed into the process, carbon outgassing by binder resin is minimized, so little carbon is found in the end product;
5.) sand and resin usage and disposal is minimized due to a new engineered mold;
6.) cooling of the poured sand casting is much faster through unique features; and
7.) better microstructure of the resulting material is realized through the rapid cooling.

A metal casting system for delivery of molten metal in a controlled environment is disclosed that includes a melting furnace having a molten metal surface and an inert furnace atmosphere throughout the entire casting system and a pressurized metal delivery vessel connected to the melting furnace with a discharge opening dam for maintaining a production level of molten metal to deliver clean, oxide-free metal from below the molten metal surface. In addition, a treatment vessel is connected between the melting furnace and the metal delivery vessel to provide a supply of molten metal from the melting furnace to the metal delivery vessel. A transfer valve allows metal flow from the melting furnace to the metal delivery vessel without any exposure to an oxidative atmosphere.

Another aspect of the invention involves disclosure of an engineered sand cast mold for receiving molten metal from the pressurized metal delivery vessel, wherein said mold is at least partially encapsulated to contain a reduced amount of sand in the sand cast mold. Further aspects of the invention will be disclosed hereinbelow.

Although the invention will be described by way of examples hereinbelow for specific embodiments having certain features, it must also be realized that minor modifications that do not require undo experimentation on the part of the practitioner are covered within the scope and breadth of this invention. Additional advantages and other novel features of the present invention will be set forth in the description that follows and in particular will be apparent to those skilled in the art upon examination or may be learned within the practice of the invention. Therefore, the invention is capable of many other different embodiments and its details are capable of modifications of various aspects which will be obvious to those of ordinary skill in the art all without departing from the spirit of the present invention. Accordingly, the rest of the description will be regarded as illustrative rather than restrictive.

BRIEF DESCRIPTION OF THE DRAWINGS

For a further understanding of the nature and advantages of the expected scope and various embodiments of the present invention, reference shall be made to the following detailed description, and when taken in conjunction with the accompanying drawings, in which like parts are given the same reference numerals, and wherein.

DETAILED DESCRIPTION OF THE INVENTION

Figure 1:
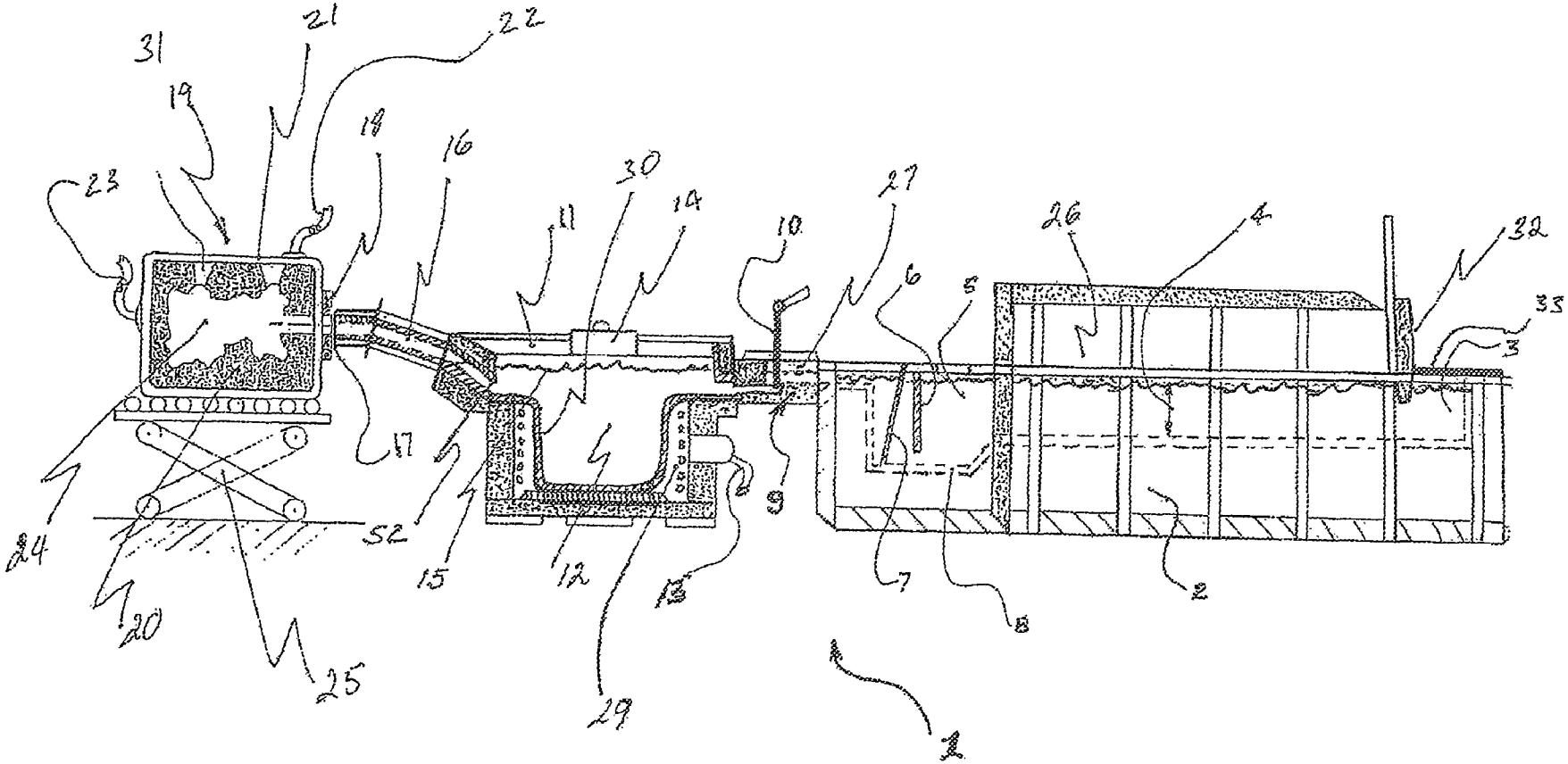
FIG. 1 is a side diagrammatic view of a metal casting system made in accordance with the present invention.

In accordance with the present invention, a casting process is disclosed that will achieve a continuous production flow of large and small complicated structural component metal castings of premium quality. Such castings are preferably produced in a low pressure, relatively low temperature precision sand cast process at the lowest manufacturing cost. The process is capable of randomly accommodating any mix or sequence of casting geometries. This process is illustrated in FIG. 1 showing an overall view of all the components making up the totally integrated lightmetals casting system, generally denoted by the numeral 1.

Although the current view is that this system may be used for casting any metal or cermet, it is most advantageous for casting lightmetals. Although magnesium is the most desired lightmetal, the present invention also envisions the use of magnesium, aluminum, lithium, sodium, cermets of these metals, or alloys thereof in particular. Certain magnesium-aluminum alloys are the most likely candidates. However, throughout this specification, these materials will collectively be referred to as lightmetals. As there is a 300-year supply of magnesium in China and Australia, and magnesium exhibits the desired properties, it is likely that magnesium will be the most requested lightmetal.

Potential castings to be made from magnesium include, but are not limited to, the following list of car and truck components: engine blocks, cylinder heads, crossarms; shotguns; A&B pillars, all door closures, lift gate closures and gate lifter frames; upper/lower control arms; engine cradles; suspension sub-frames; crossmembers; pick-up/cargo box; semiconductors and structural reinforcement members.

In yet another aspect of the present invention, a resulting lightmetal casting may be further encapsulated in a protective plastic body in accordance with the inventions of U.S. application Ser. Nos. 10/239,039 and 10/481,100 and International Application Nos. PCT/U.S.2003/030842 and PCT/US2003/030843, which are all incorporated herein by reference. Hence, a cast magnesium crossmember casting may be sandwiched and either wholly or partially encapsulated in plastic to provide corrosion protection. In those specifications, there are listed various reinforcements and inserts which can be encapsulated between the sandwich skins. The present invention would produce lightmetal castings that would be ideal for encapsulation via the processes and articles claimed in the above-mentioned patents and patent applications.

The first aspect of the present invention shown in FIG. 1 is a metal casting system 1 including a melting furnace 2 constructed according to conventional specifications for melting systems. The furnace is preferably a heated launder-melting furnace that receives a supply of molten metal via any traditional method, including a delivery mechanism such as a conduit from a large melting furnace, or it may even be filled from small molten ingots. The furnace can be electrically and/or gas heated with insulated metal holding and transfer vessels 8 as well as transfer channels. Pouring a magnesium casting requires a steel lining in the melting, holding and transfer vessels. The melting and holding furnace 2 is monitored for temperature to prevent metal overheating and excessive oxidation. Furnace 2 is under an inert furnace atmosphere that keeps oxide and dross formation to a minimum. This atmosphere may be selected from the group consisting of sulfur hexafluoride, nitrogen, argon, helium, other inert gases and combinations thereof. The magnesium ingot and/or molten magnesium metal is introduced into the furnace receiving well 3 and covered with an insulated heat shield 33 to maintain the inert furnace atmosphere 26 and reduce heat loss. The metal depth 4 is maintained at the highest level in order to assure the production metal level 15 is kept above the low pressure discharge opening dam at all times during operation and while on idle standby. Maintaining the metal level at the high point 15 assures maximum metal pour availability and delivery of clean, oxide free metal from below the molten metal surface to the mold. Furnace clean out and metal oxide/dross removal is achieved via the furnace charge door 32. Because the entire furnace/molten metal holding system is maintained under a protective atmosphere 26, oxide and dross generation will be kept to a minimum. The protective atmosphere may be any suitable gas, but is preferably SF6 or N2 gas. Because the mold is clean from the inert gases running therethough, there is minimal carbon outgassing.

The second aspect of the present casting system is a heated metal holding/treatment vessel 5 attached directly to the melting furnace, thus providing a continuous supply of hot metal flow to the electrically heated low pressure metal delivery system 12 via a molten magnesium metal transfer valve 9. The metal in the holding furnace is monitored for temperature continuously and for chemistry specification compliance through frequent audits. The holding furnace is where chemical analysis adjustments and molten metal grain refinements are made. The metal flow from the holder to the molten metal transfer valve 9 is forced up from below the surface due to a baffle 6 with a subsequent passage through a metallic filter 7 before entering a atmosphere controlled 27 transfer valve chamber.

Figure 4:
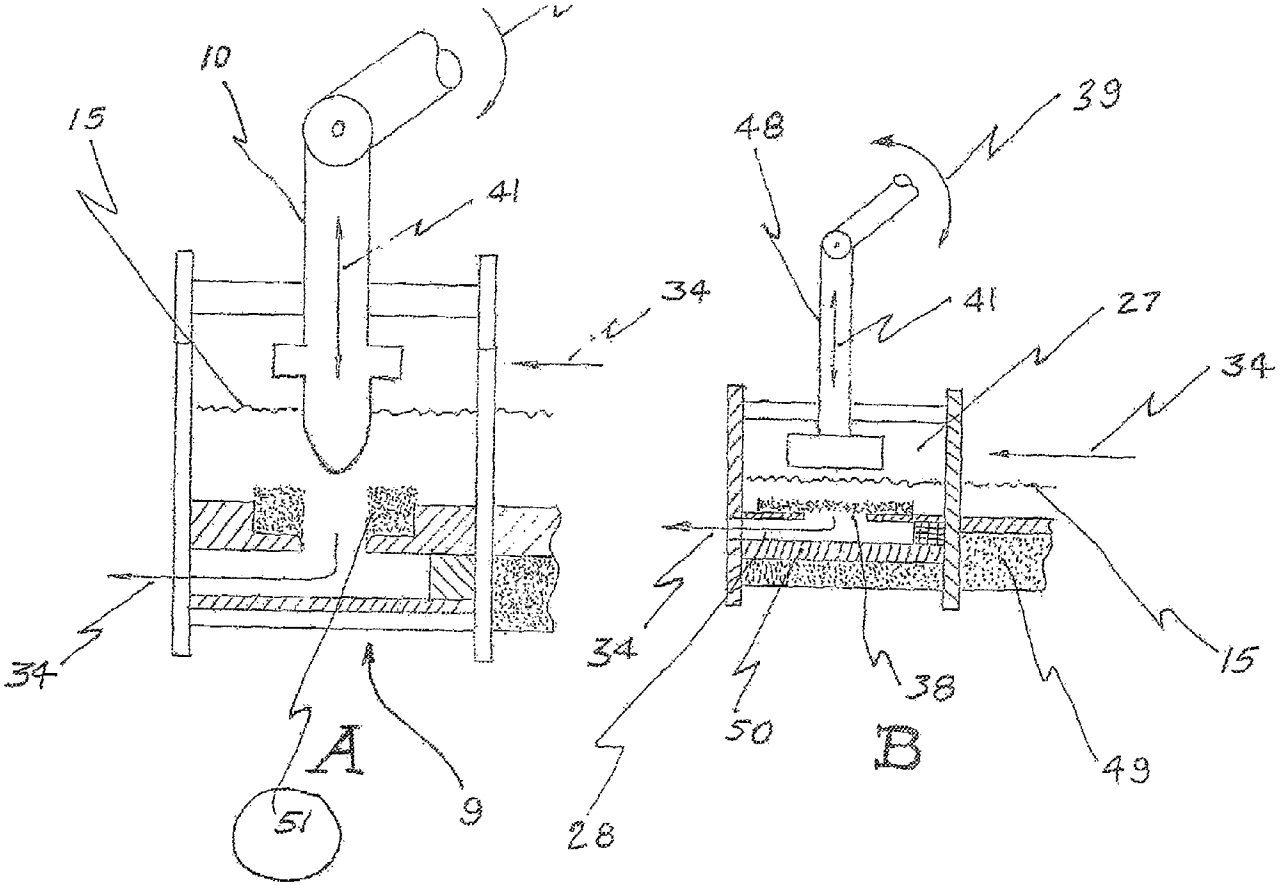
FIG. 4A is a side elevational view of a new stopper rod.
FIG. 4B is a side elevational view of a new stopper rod.

The third aspect of the present invention for a metal melting, holding and pouring system is the novel molten magnesium metal transfer valve 9 which is useful to the successful continuous low pressure casting operation. The main function of the transfer valve system is to provide a pressure tight seal for the low pressure furnace during the mold pour cycle via the stopper rod 10 in the closed position and open position, described in more detail with respect to FIGS. 4 A&B, elements 10 and 48 respectively, to immediately replenish the low pressure vessel to the original metal level 15 position shown in FIG. 2, after receiving a "mold full" signal.

Still referring now to FIG. 1 and FIGS. 4A and 4B, collectively, a stopper rod 10 is preferably made of steel and it can be of two design configurations, such as those shown as 10 and 48 in FIGS. 4A and 4B, collectively, after receiving a mold full signal, depending on the need and/or desire for additional molten metal filtration. As can be viewed in FIGS. 4A and 4B, the combination metal gasket/filter steel wool 38 requires a different design stopper rod 48 than the straight gasket 51, preferably made of steel wool-based material, design of stopper rod 10, shown in FIG. 4A.

In both instances, the stopper rod performs the function of sealing the low pressure furnace during the pour cycle and opens for low pressure furnace refill cycle. The stopper rod motion 41 is vertical as shown in FIGS. 4A and 4B, and it is achieved or activated through electromechanical motion 39. When the stopper rod is in the open position, metal flows 34 into the transfer valve system and flow continues 35 through a channel 28 into the low pressure vessel 12. The transfer valve chamber is steel lined and insulated 50 and 49 like the entire molten metal holding system.

Figure 2:
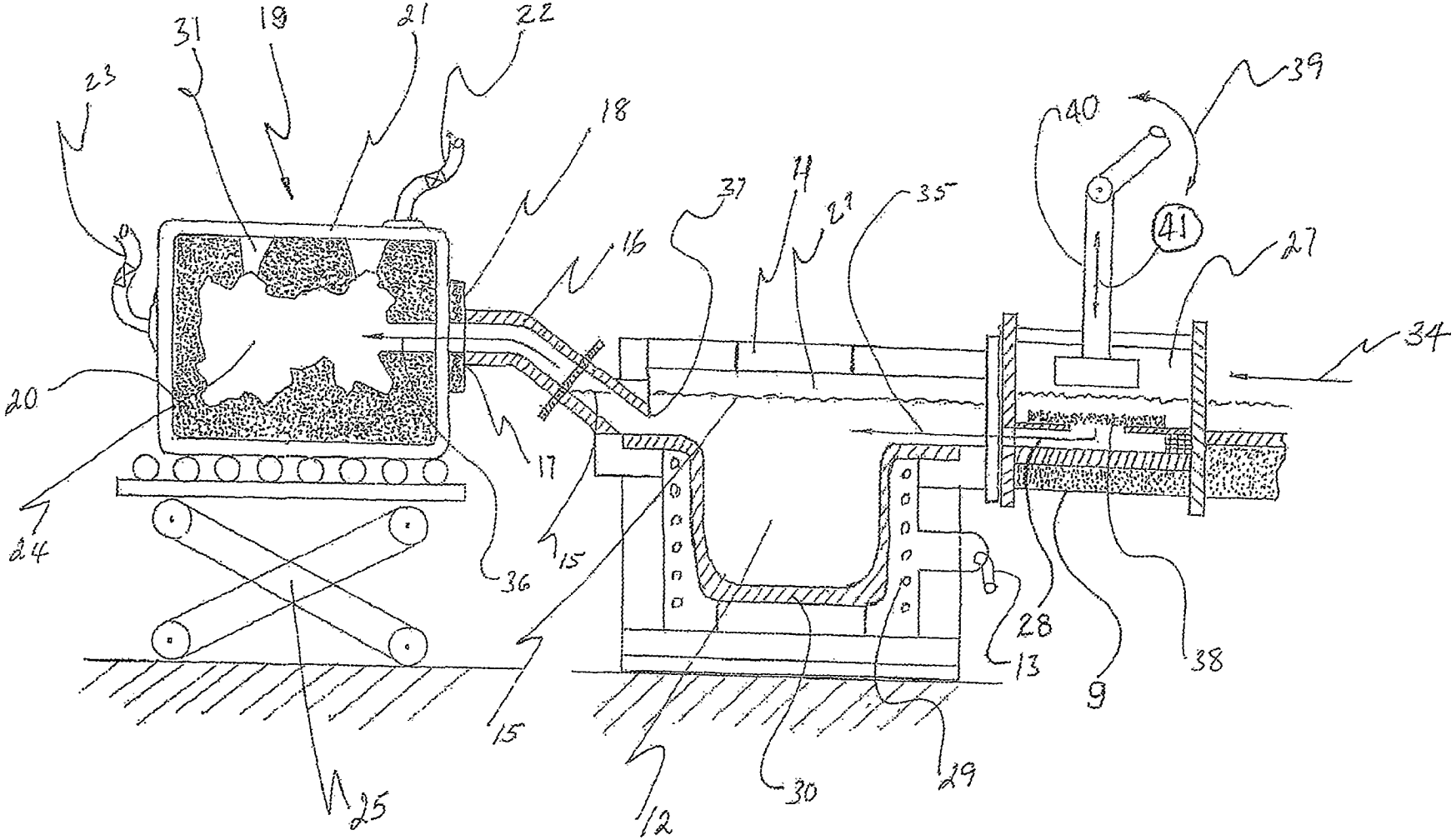
FIG. 2 diagrammatically details a close-up of portions of the system.

Looking now to the fourth aspect of the present system is the low pressure metal delivery system 12 which is electrically heated 29 and pressurized with an inert gas 27 as recommended for molten magnesium. The inert gas inlet valve 13, and is activated with every casting cycle requiring furnace pressurization. The pressurization gas is captured with every pressure exhaust cycle for reuse in order to minimize the overall operating cost. The metal holding vessel 30, shown in FIG. 2 is a specially designed cast steel vessel which is uniformly heated from bottom to the top. The top cover 111 of the low pressure furnace serves as a clean-out hatch, as well as an observation port. Metal level indicators can also be incorporated for additional security to monitor the proper furnace metal level to assure that metal level never falls below the dam 37 at the discharge port. Under pressure the molten magnesium is pushed up the discharge nozzle 16 which makes contact with the mold 17 and allows the metal to flow 36 rapidly and quiescently into the mold cavity 24.

Figure 3:
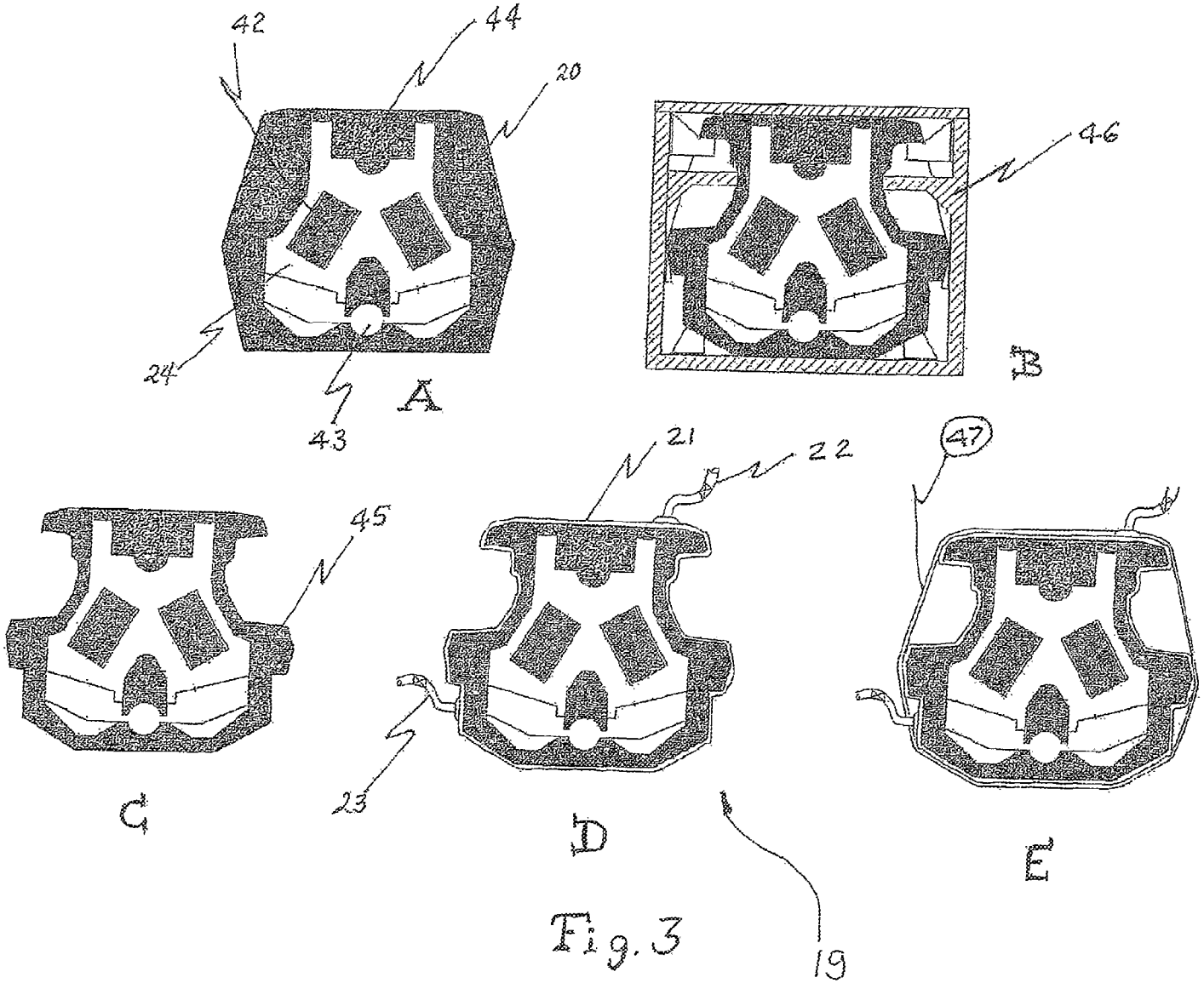
FIG. 3A. is a side cutaway view of a prior art engineered mold.
FIG. 3B is a side cutaway view of another prior art engineered mold.
FIG. 3C is a side cutaway view of the new engineered mold using less sand.
FIG. 3D is a side cutaway view of the new engineered mold including the gas ingates of a fully encapsulated, self-contained mold.
FIG. 3E is a side cutaway view of the new engineered mold including the gas ingates, along with fiberglass straps.

FIGS. 3C, 3D and 3E show a fifth aspect of the present invention. This aspect is a novel custom engineered ultra lightweight mold that is an improvement over the prior art shown in FIGS. 3A and 3B. The new engineered mold reduces the need for about one half of the necessary sand as it is at least partially isolated from the environment by being at least partially encapsulated, thereby urging the gases to flow through only portions of the sand mold. In one embodiment of this aspect of the invention, a sand mold is fully encapsulated with a vacuum pack plastic bag for rigidity and encapsulation. Although many different encapsulants may be used, such as plastic film, sprayed on plastic coatings, metallic foils, waxes and the like, shrink wrap plastic has been found to be quite advantageous because it is fully effective and may be applied at a low cost. Aluminum foil has been used to advantage as well when casting molten aluminum, as no contamination is then possible. Furthermore, these inexpensive and lightweight materials readily conform to any needed shape and are easy to dispose of, and cost very little. In this embodiment, an exterior reinforcement may be used, such as a fiberglass strap, to secure the sand mold during the casting process.

By at least partially encapsulating the sand mold, a controlled environment gas may be used even during the casting process, helping to alleviate oxidation of the metal being poured therein. It has been found to be advantageous to leave certain areas of the sand mold, such as at the part line, or at the top and the bottom, un-encapsulated so as to allow the use of a vacuum as well as various gases to flow therethrough. For example, tests were conducted on the cooling cycle of a sand mold when a metal chill had been incorporated into the sand mold while it was being made. By using a vacuum followed by purging with a heat transfer gas and subsequent filling of the sand mold with molten metal, an enhanced cooling rate was experienced. Due to these effects, large structural castings with thin walls on the order of one to five millimeters can be produced as during the metal fill cycle, the mold will be subjected to a slight vacuum to assist in removing core gases generated in the mold cavity by the outgassing of the carbonaceous binder resin, and thereby allowing rapid dispersion of the molten metal. The sand mold is permeable, by its very nature, so a slight vacuum can be applied because the outer exterior surface of the sand mold is at least partially encapsulated. The molten metal will be delivered into the narrow mold passages so quickly, due to the vacuum pulling the molten metal through the mold, that these thin walled structural castings are possible. When vacuum is applied, on the order of 15-200 inches of water, the lack of oxygen only allows a light outgassing of carbon from the mold resin because there is little or no reactive breakdown of mold binder resin. This results in an unexpectedly environmentally friendly situation because there is no gas emitted when the mold is opened.

Figure 5:
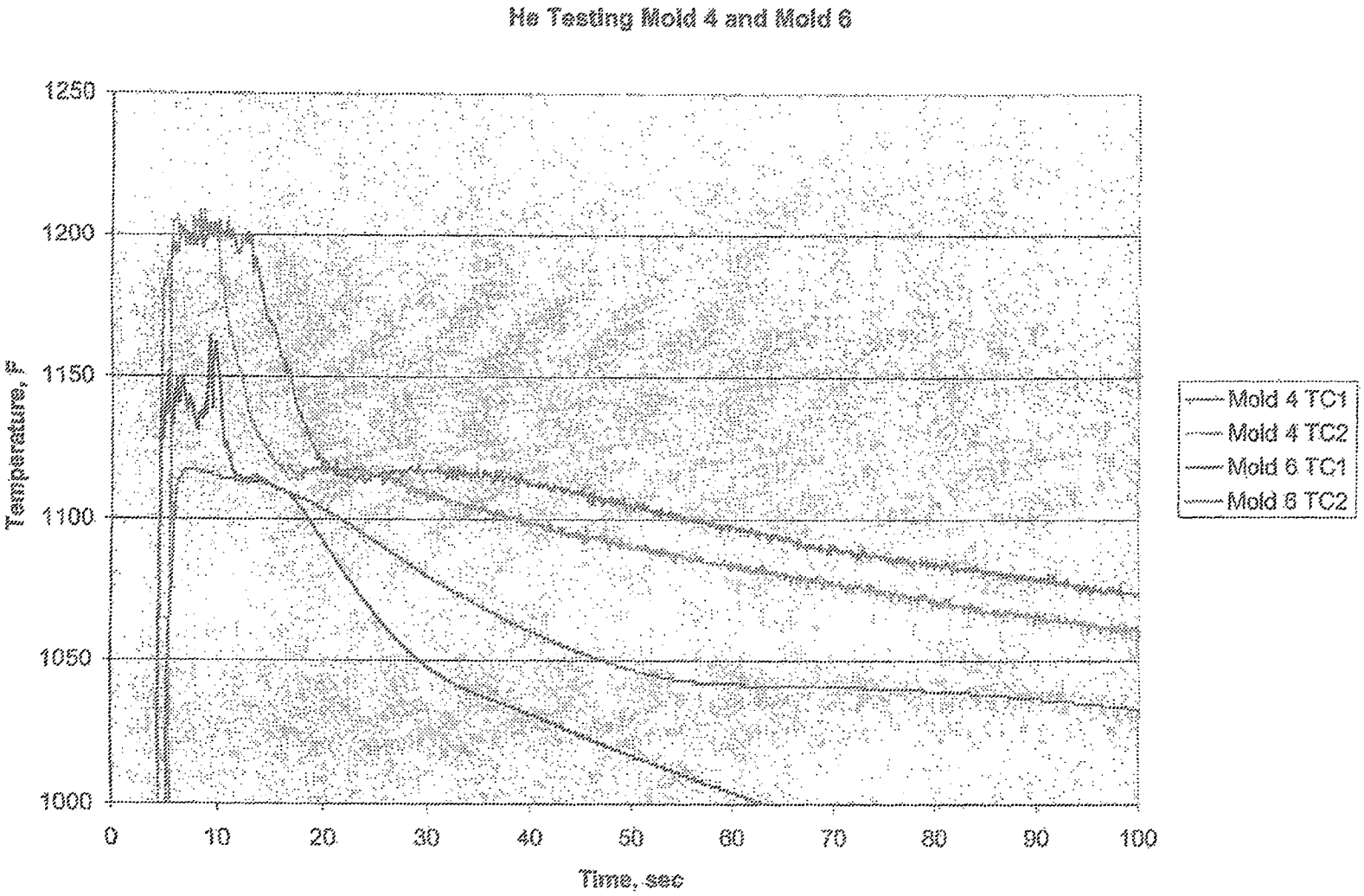
FIG. 5 is a cooling rate graph showing the relative cooling rates with different aspects of the present invention.
Figure 6:
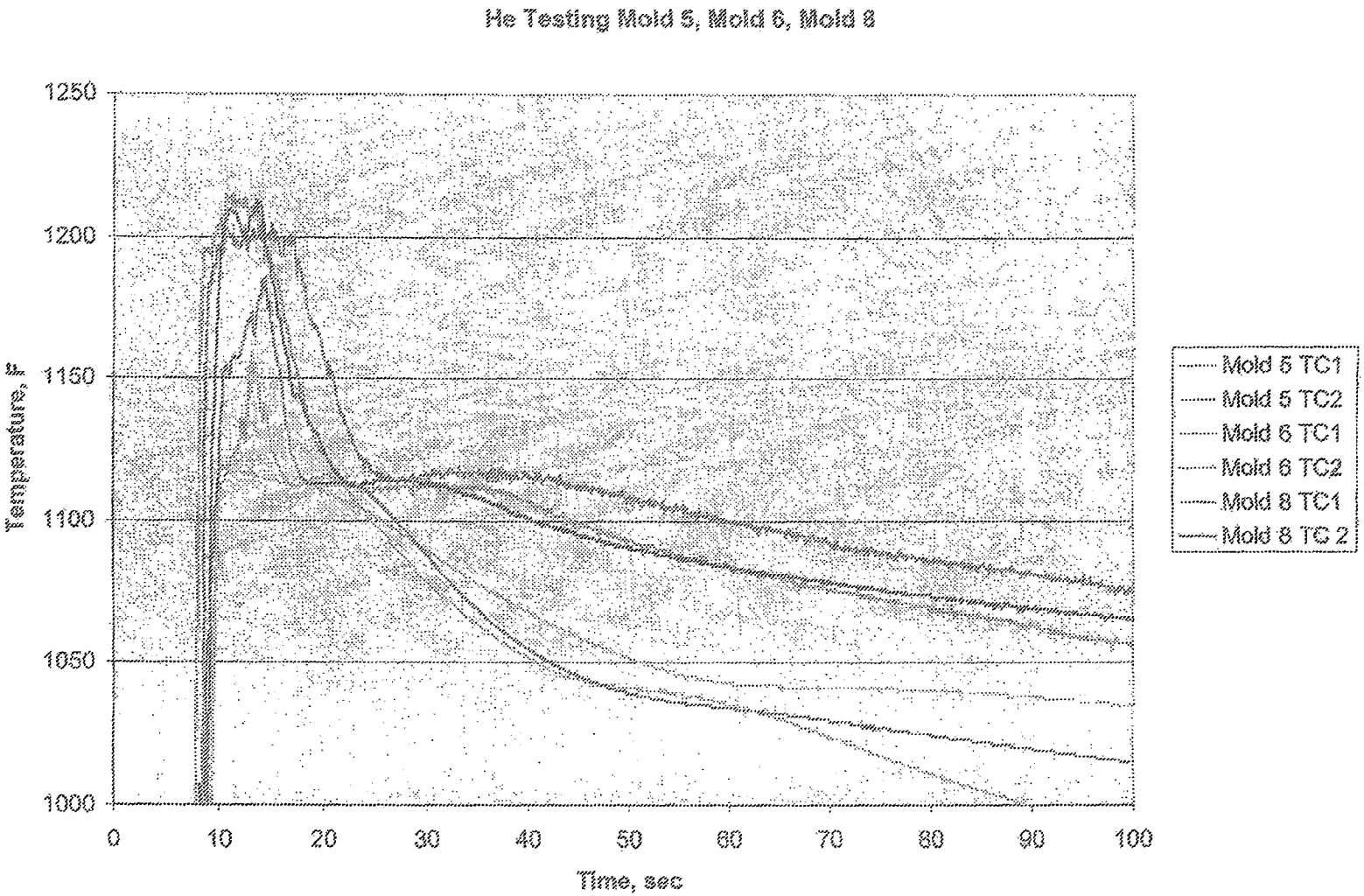
FIG. 6 is a cooling rate graph showing the relative cooling rates with different aspects of the present invention.

Although such a slight vacuum may be drawn through the encapsulated sand mold, an optional heat transfer gas may also be purged through the mold prior to the casting. Such a heat transfer gas may include helium, argon, nitrogen, or combinations of these gases. A gas ingate in communication with the sand mold flows this gas through the mold for a relatively short period of time, on the order of 60 seconds or so, prior to the casting, and thereafter the metal is drawn or poured into the mold. The gas is flowed through for a sufficient amount of time to purge the sand mold of any oxidizing or atmospheric gas that might cause oxidation of the molten metal. Although the use of such a heat transfer gas is not necessary, it has been found that the use of such a gas prior to casting has a positive effect on the cooling rate of the casting after the pour. The best results were found when pre-chilling the transfer gas before drawing it through the mold. The results of testing is shown in FIGS. 5 and 6, described more fully hereinbelow. The heat transfer gas may also be flowed after the pour for further cooling effects, which reduces cycle times even further.

Creation of a negative pressure environment not only helps to remove oxidizing gases, but the rapid cooling rate creates a material with a tight dendrite arm spacing, on the order of 30 microns or less. By pre-chilling the heat transfer gas used, even further increases in the cooling rate can be achieved. Such a pre-chilling may be at any reduced temperature, but pre-chilling down to −40° C. has been tested with good success. These desirable material microstructure traits help to create a stronger casting as well as reducing the cycle time.

By utilizing a sand that is permeable and at least partially encapsulated for a sand mold, maximum cooling can be achieved. Although any suitable sand may be used, the sand mold may be most preferably made of silica sand, olivine sand, zirconium sand, or any combination thereof. Coarser sand may be used in the outermost portions of the mold, while a finer sand may be used in the areas closest to the face of the mold. The coarser sand would allow greater vacuum or heat transfer gas flow, while the finer sand would require a higher vacuum to impart a smoother surface on the resulting sand cast part. For reduced cooling cycle time, zirconium sand has been found to be the preferable sand, although any of the mentioned sands can be used.

Optionally, the use of a mold chill, or a heat dissipative piece incorporated into the sand mold during its formation, helps to cool the metal in the mold after the pour has taken place. Heat conductive chills may be made of steel, copper, aluminum, silicon nitride ceramic, metallic cermets of combinations of metal and ceramic, or any combination thereof. Metal chills are standard in the sand cast industry, and they are usually made of steel. These "chill" pieces are recovered after the casting and reused in further molds. Heat transfer gasses allow for chill designs with fins to facilitate rapid cooling of the chill and thus the molten metal in the mold.

FIGS. 5 and 6 show that upon testing of the various materials described above, it was found that the most thermally conductive particulate media was zirconium sand. Further, the most thermally conductive metal chill was a copper chill, and the most thermally conductive cooling gas was a pre-chilled helium gas. FIG. 5 shows 4 different experiments in which the uppermost graph illustrates the control unit made with no cooling gas and no chill used in the mold. The next lower graph illustrates a casting made with helium cooling gas without a chill in the mold. The third lowest graph illustrates no cooling gas used, but with the use of a metal chill, while the bottom graph shows the use of helium cooling gas in combination with the use of a metal chill. As can be seen, the fastest cooling time was experienced with using helium cooling gas in combination with a metal chill.

FIG. 6 shows the results of three more tests, each with a TC1 and a TC2 reading. TC1 means that a thermocouple was placed above the incorporated chill where the temperature would be the lowest, while TC2 shows the readings of a thermocouple placed nearest the ingate, where the temperature would be the highest. Mold 6 has the slowest cooling rates as it does not use a cooling gas, which is evident by looking at the graph. Mold 5 showed the best results, because it was made using helium gas as a cooling gas, while Mold 8 used nitrogen cooling gas. The sand was the same for all molds, intended to isolate a comparison of the effect of the cooling gases. Mold 5 cooled from about 1200° F. to about 1000° F. in around 90 seconds, and was the fastest cooling cycle of the group.

This novel sand mold assures premium quality castings at high production rates, generally on the order of 30 second cycle times, instead of the traditional 5 minute solidification, resulting in low manufacturing costs. When compared to conventional molds shown in FIG. 3A, the present mold construction is lighter due the fact that less sand is needed to make a mold with the significant contouring of the exterior surfaces. Reducing the mold weight has an overall manufacturing cost reduction effect because of reduced sand usage and its necessary disposal, reduced resin binder usage, sand handling, and lower capital investment and reduced sand reclamation processing. The sand mold is permeable and preferably manufactured with sand and resin binders having approximate sand to air density ratios of 4 to 1. Also, the engineered mold 45 shown in FIG. 3C is contoured to minimize sand and binder usage to approximately half of conventional molds FIG. 3A thus providing substantial cost savings in mold material usage.

The contoured, lightweight sand core elements to make up a mold may be assembled and encapsulated with a plastic encapsulant or other appropriate materials 21 in order to contain the mold segments together during the pouring cycle while maintaining its dimensional geometric cavity integrity and facilitate negative mold pressure and heat transfer gas flow to all the cast metal in the mold. In addition to the encapsulant, the mold can be secured with fiberglass strapping 47 to assure support throughout the casting solidification cycle and the onset of mold degradation due to heat from the casting.

FIG. 3A shows a typical prior art engineered mold which uses way too much sand, and it could have the following elements: 1) outer sand cores acting as molten metal containment segments 20; 2) a metal chill 44 to facilitate rapid directional solidification in order to improve quality and mechanical properties toward the ingate 43, the last metal to enter the mold cavity and thus the hottest metal feeding the main body of the casting; and 3) the use of internal cores 42 to form internal geometric surfaces. This mold produces a lot of sand/binder combination to be disposed of and does not permit the use of a controlled environment or the use of a vacuum. The same casting can be made with the new improved method and system of the present invention.

FIG. 3B shows another prior art invention generally denoted by the numeral 46. Although it has been found to be nonfeasible in a manufacturing setting, this earlier containment approach to reduce mold weight has been patented and proposed the use of a metal fixture allowing the lightweight mold segments to be assembled in the fixture for support and retention. However, a big problem arose when dealing with the left over metal fixtures, as they had to be reclaimed after the sand mold was removed from the casting. Factories were having to sort and store numerous sizes for various castings, and this became a large problem. The fixtures were heavy enough to require handling with hi-lo's and the like, also causing a handling problem. The present invention discloses an encapsulant which is easy to make and dispose of after use. They can even be recycled, depending upon the material chosen. Plastic shrink wrap can be kept in a recycling bin waiting for pick-up, or if aluminum foil is used, it can also be recycled. Since the encapsulant conforms to the shape of the mold, there isn't a need for multiple sizes and shapes of fixtures. This aspect alone is very desirable for a manufacturing setting. This allows for reduced manufacturing floor space, increased capacity per square foot of floor space and reduced sand handling, reclamation/dumping and usage with a greatly improved cycle time.

FIG. 3D shows an embodiment of the present invention in which the encapsulant may also preferably incorporate two nozzles 22 and 23 in order to facilitate drawing a vacuum on the mold and/or continuously or non-continuously flushing the mold with non-reactive or inert gases such as helium, nitrogen, argon, $SF_6$ or $CO_2$, to provide an inert mold cavity environment. The inert gas may continuously be drawn through the mold to purge, or it may be intermittently purged to achieve certain heat transfer results. Helium gas is an exceptionally attractive gas due to its inert behavior as well as its enhanced thermal conductivity compared to air. When flushing the mold of all the entrapped air and displacing it with helium, we achieve two benefits: first, the mold cavity has an inert non-oxidizing environment which is very conducive for casting reactive lightmetals, such as molten magnesium; and, second, the new helium/sand composite has a metal-mold interface which exhibits significantly better heat extraction capability leading to more rapid casting solidification. Also, the ability to draw a light vacuum on the mold facilitates thin wall castings with large surface areas.

As shown in FIG. 2, a typical casting process in accordance with the present invention is initiated when a engineered mold 19 is located by a device 25 and pressed into contact with a low pressure nozzle 17 which is separated by an insulation gasket 18. The entire mold is wrapped in plastic and is either flushed with helium under a slight vacuum or not, depending on casting requirements when the molten metal is pushed counter gravity into the mold cavity. This controlled atmosphere process is advantageous because the metal is never exposed to the oxygen in the air from the time it is melted to the time it enters the mold cavity. A high purity foil of the lightmetal to be poured may be placed over the nozzle opening in order to prevent contamination of the resulting article when the encapsulant, perhaps plastic shrink wrap, is melted by the molten material and would go into the mold. The first contact the molten metal makes when being drawn into the mold is to burn through the metallic foil ingate cover 77 followed by filling the mold cavity gently but fast, on the order of 10 to 20 pound/second fill rate all the way up to feed risers 31. Under these casting conditions, it is possible to produce premium quality castings at the lowest possible manufacturing cost.

Decoupling of the mold can be done by any number of standard methods, including three in particular: 1) allowing solidification and then removal; 2) sand slides to cut off the nozzle opening; and 3) rotating the mold to make the mold rollover to seal in the molten material. These methods may both be accomplished while still under vacuum. These three methods are equally effective, although one may be better than the other for economic or time constraints.

The foregoing description of a preferred embodiment of the invention has been presented for purposes of illustration and description. It is not intended to be exhaustive or to limit the invention to the precise form disclosed. Obvious modifications or variations are possible in light of the above teachings with regards to the specific embodiments. The embodiment was chosen and described in order to best illustrate the principles of the invention and its practical applications to thereby enable one of ordinary skill in the art to best utilize the invention in various embodiments and with various modifications as are suited to the particular use contemplated.

INDUSTRIAL APPLICABILITY

The present invention finds utility in the industry of automobiles and airplanes for making lightmetal sand castings of structural components including engine blocks, cylinder heads, and many other structural castings.

What is claimed is:

1. A metal casting system (1) for continuous delivery of molten metal in a controlled environment, comprising:

a melting furnace (2) having a molten metal surface and an inert furnace atmosphere throughout the entire casting system, wherein said inert furnace atmosphere is inert to the metal being cast;

a pressurized metal delivery vessel (12) connected to the melting furnace (2) with a discharge opening dam (6) for maintaining a production level (4) of molten metal to continuously deliver clean, oxide-free metal from below the molten metal surface;

a treatment vessel (5) connected between the melting furnace and the metal delivery vessel to provide a continuous supply of molten metal from the melting furnace to the metal delivery vessel;

a transfer valve (9) that allows metal flow from the melting furnace to the metal delivery vessel, wherein the transfer valve includes a stopper rod made of steel and a filter made of steel to facilitate continuous pouring; and an engineered sand mold comprising a binder for receiving molten metal from the pressurized metal delivery vessel, wherein said engineered sand mold is at least partially encapsulated to contain a significantly reduced amount of sand in the sand mold and facilitating maintenance of a controlled atmosphere with inert gases, wherein a gas impermeable exterior barrier layer incorporated into the exterior surface of the engineered mold, the exterior barrier layer provides environmental isolation from the ambient atmosphere; and a source of inert gas connected to the engineered sand mold.

2. The system of claim 1, wherein the melting furnace is a heated melting and treatment furnace connecting the pressure furnace by a launder.

3. The system of claim 1, wherein the inert metal casting system is a pressurized system that utilizes an inert atmosphere that is inert to the metal being cast, and wherein the atmosphere is selected from the group consisting of $SF_6$, $N_2$, Argon, helium, hydrogen and combinations thereof of those gases.

4. The system of claim 3, wherein the metal casting system exerts a cooling effect accomplished by the use of a heat transfer gas.

5. The system of claim 3, wherein the metal casting system exerts a cooling effect accomplished by the use of a helium-containing heat transport gas.

6. The system of claim 1, wherein said system is adapted for creating and maintaining a useful environment within the mold to allow for countergravity pouring with an inert atmosphere and high heat transfer characteristics that increase production.

7. The system of claim 1, wherein the stopper rod seals against the filter which is made of steel wool.

8. The system of claim 1, wherein a useful environment is created and maintained for countergravity pouring of magnesium in its molten state, without the use of any ceramic parts, and having a controlled environment without any oxygen in the system to prevent oxidation during a pour.

9. A method of metal casting of molten metals in a controlled environment, comprising:

heating metal to a molten state to maintain a metal depth level to feed and compensate for the drawoff during the molding process;

maintaining an inert atmospheric environment over the molten metal;

delivering the molten metal through a transfer valve, wherein the transfer valve includes a stopper rod made of steel and a filter made of steel;

drawing the molten metal into a low-pressure engineered mold that is at least partially encapsulated by a gas impermeable exterior barrier layer incorporated into the exterior surface of the engineered sand mold, and wherein the engineered sand mold comprises a binder;

maintaining an inert atmosphere during heating, drawing, and molding;

pressurizing the molten metal in a molten bath tank to urge the molten metal countergravity up into the engineered mold which has been purged to maintain an inert atmosphere, whereby non-turbulent filling of the mold is possible in a non-oxidative environment, allowing for rapid filling of the mold as no oxide issues are present.

10. The method of claim 9, further comprising continuously filling molds through countergravity filling and vacuum applied within the mold and low-pressure pushing onto the molten metal.

11. The method of claim 9, further comprising an additional step of applying a vacuum to the engineered mold prior to filling and purging with an inert gas to prevent contamination and to allow for faster cycling times of the mold.

12. The method of claim 11, further comprising a step of incorporating a chill into the mold, whereby the heat transfer gas can cool both the mold and the chill, thereby enhancing the cooling efficiency and the cycle time of the mold.

* * * * *